United States Patent [19]

Beatty

[11] Patent Number: 4,887,445

[45] Date of Patent: Dec. 19, 1989

[54] ELECTRONIC LOCK FOR HOTEL ROOM SAFES AND THE LIKE

[75] Inventor: Scott M. Beatty, Nicholasville, Ky.

[73] Assignee: Sargent & Greenleaf, Inc., Nicholasville, Ky.

[21] Appl. No.: 359,043

[22] Filed: May 30, 1989

[51] Int. Cl.[4] ..... E05B 49/00

[52] U.S. Cl. ..... 70/278; 70/214

[58] Field of Search ..... 70/277, 278, 279–282, 70/212–214, 132–134; 340/825.31, 825.56

[56] References Cited

U.S. PATENT DOCUMENTS

| | | | |
|---|---|---|---|
| 3,878,511 | 4/1975 | Wagner | 340/825.31 |
| 3,881,171 | 4/1975 | Moorma | 70/271 |
| 3,953,769 | 4/1976 | Sopko | 340/825.31 |
| 4,148,092 | 4/1979 | Martin | 70/278 |
| 4,670,747 | 6/1987 | Borras | 340/825.56 |
| 4,684,945 | 8/1987 | Sanderford | 70/278 |
| 4,831,370 | 5/1989 | Smoot | 340/815.31 |

*Primary Examiner*—Robert L. Wolfe

*Attorney, Agent, or Firm*—Mason, Fenwick & Lawrence

[57] ABSTRACT

An electronic lock controlled safe for hotel rooms and the like including a box-like safe having a safe door and door frame, an electronic lock mounted on the door including a forwardly exposed keypad and display window assembly, the keypad having plural finger-actuated keys with associated numerals and legends and an associated electrically activated alpha-numeric display strip located adjacent the keypad for displaying messages through the display window to an operator. The lock mechanism on the door includes a bolt movable between projected and retracted positions respectively for locking and unlocking the door, an electric motor and drive wheel mechanism driven thereby including a slip clutch, a movable link member coupled to the slip clutch and the bolt, photoelectric light sensors positioned adjacent the link providing sensor beam paths selectively intercepted by portions of the link for sensing predetermined positions of the link, and microprocessor circuitry responsive to signals from the keypad keys and the sensor signals for activating the display strip to display predetermined messages and for activating the electric motor to move the bolt to projected and retracted positions.

18 Claims, 4 Drawing Sheets

ELECTRONIC LOCK FOR HOTEL ROOM SAFES AND THE LIKE

BACKGROUND AND OBJECTS OF THE INVENTION

The present invention relates in general to security containers with changeable locks, and more particularly to hotel and motel room safe boxes with electronic locks.

Heretofore, various types of key controlled security boxes for hotel and motel rooms and the like has been provided, in response to recognition that the prior practice of allowing hotel guests to deposit their valuables in the hotel safe was inconvenient and was not widely used except for safeguarding articles of high value such as fine jewelry, expensive cameras and the like. The need was recognized to provide a convenient means for security storage of valuables in each hotel or motel room wherein control of the lock was readily changeable for each change of the occupant of the room.

Security storage containers which have been heretofore provided especially adapted for use in the guest rooms of hotels and motels have been frequently designed to be secured to the wall or floor in the hotel room closet and, in many cases, were coin operated, key locked containers wherein the key was removable from the lock only after deposit of a coin in an appropriate coin receiving and sensing mechanism associated with the key lock.

An object of the present invention is the provision of an electronic safe lock for hotel and motel room safes and the like which retains the security of mechanical locking mechanisms but employs electronic technology to provide logic, memory and reliability of operation, wherein the occupant of the room can enter the occupant's personal choice of a personal identification number code, and which is capable of being changed for each new occupant of the room.

Another object of the present invention is the provision of an electronic safe lock for hotel and motel room security storage containers or safes which include a microprocessor-controlled programmable electronic safe lock, which includes a master code for operation of the lock by the hotel proprietor or hotel management, and which is more reliable than solenoid operated electrical or electronic locks.

Yet another object of the present invention is the provision of an electronic safe lock as described in the two preceding paragraphs, wherein positive locking of the bolt by an overcenter slip clutch mechanism is provided, and which includes protection from damage in the event of the bolt becoming jammed by the door jam.

Still another object of the present invention is the provision of a safe lock as described in the preceding paragraphs, wherein phototransistor sensors are provided to ensure reliable detection of the position of selected components of the mechanism to provide for reliable operation, and wherein display means are provided which indicates the status of the lock during operation thereof.

Other objects, advantages and capabilities of the present invention will become apparent from the following detailed descriptions, taken in conjunction with the accompanying drawings illustrating a preferred embodiment of the invention.

DETAILED DESCRIPTION OF A PREFERRED EMBODIMENT

Figure 1:
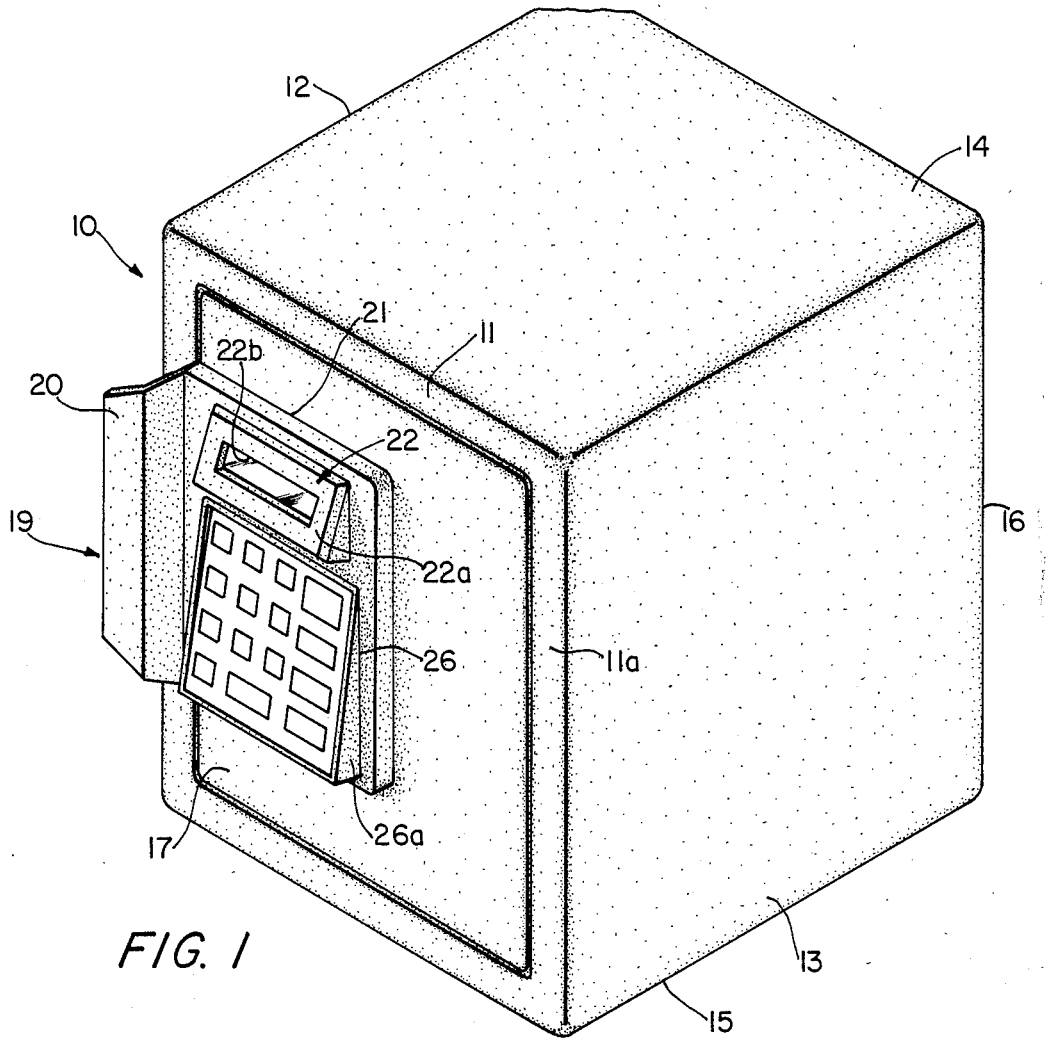
FIG. 1 is a perspective view of a security container or safe for hotel and motel rooms and similar lodging establishments having an electronic safe lock and handle assembly constructed in accordance with the present invention.
Figure 2:
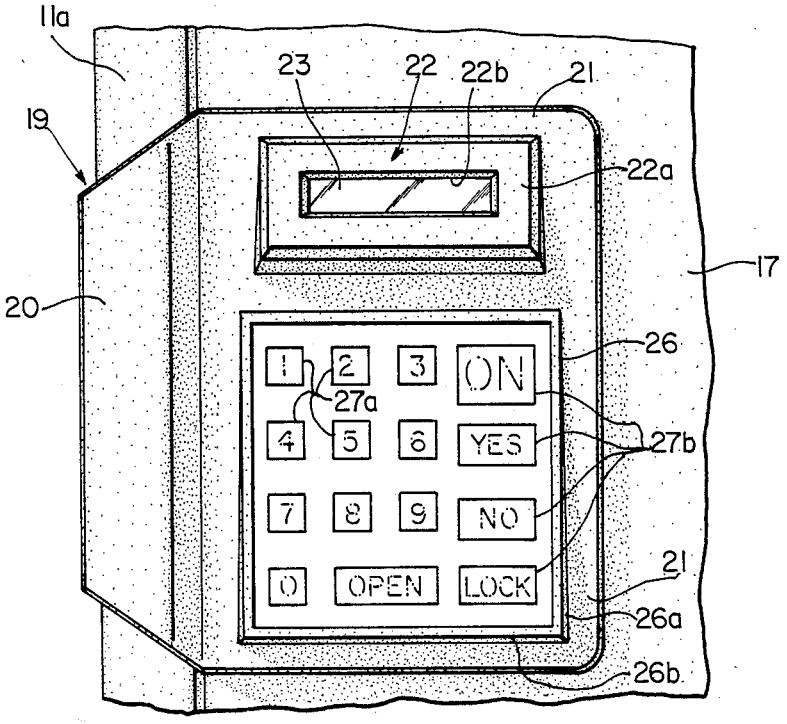
FIG. 2 is a front elevational view of the handle and electronic safe lock assembly.

Referring to the drawings, wherein like reference characters designate corresponding parts throughout the several figures, the hotel or motel room safe or security box with electronic lock constructed in accordance with the present invention is indicated generally by the reference character 10 and, in this embodiment, is of generally cube form including a front wall 11, vertical side walls 12, 13, top and bottom walls 14 and 15, and rear wall 16, defining the substantially cube shaped safe. The front wall 11 forms, in effect, a door frame **11*a* bounding an access opening closed by a safe door or closure member 17 supported on the frame 11*a* with conventional hinges (not shown), located for example along the right hand edge of the door as viewed in FIG. 1. The walls of the safe box or security enclosure 10** may be of any conventional construction, such as, for example, metal plate walls, or double walls with an intervening filler material.

Figure 6:
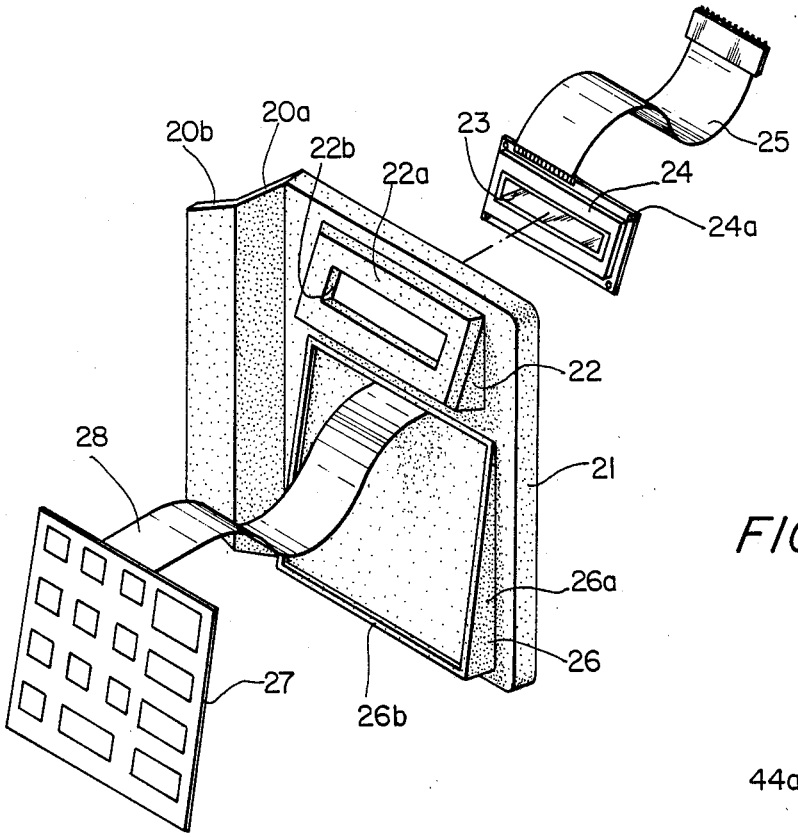
FIG. 6 is an exploded perspective view of the front cover and handle member with the associated key pad and liquid crystal display components exploded therefrom.

The exterior components of the electronic lock for the safe or security box are arranged in the form of a combined handle, keyboard, and display window assembly, indicated generally by the reference character 19, hereinafter frequently referred to simply as the handle assembly, fixed to the exterior front face of the door 17 adjacent to the free or left hand edge thereof. The handle assembly 19 includes an integral angular handle formation 20 extending from the main panel portion 21 having an outwardly and forwardly inclined leg **20*a* extending from the panel portion 21 and a terminal flange or lip formation 20*b* extending in a plane parallel to and spaced forwardly and outwardly from the panel portion 21. The main panel portion 21 includes an outwardly protruding angular window formation 22 providing an inclined face portion 22*a* framing a window 22*b* through which a liquid crystal strip portion 23 of a liquid crystal display (or LCD) unit 24 may be viewed. The LCD unit 24 has mounting flange formations 24*a*, shown in FIG. 6, through which mounting screws maybe extended to fix the LCD unit in proper position housed within the angular formation 22 with the liquid crystal display strip 23 aligned with and viewable through the window 22b. A flexcable or multiple conductor flexible cable ribbon 25 extends from the LCD unit 24** and has a plug on the end thereof for connection in an appropriate plug receptacle of the electronic assembly later described.

The main panel portion 21 of the handle assembly 19 also includes a forwardly inclined keyboard framing formation 26 having triangular side wall portions 26a and bottom wall portion 26b defining a frame and housing to receive and support the keypad 27 having a plurality of numeral bearing keys or pads 27a, formed for example of pressure sensitive switches of known design, together with indicia bearing keys or pads 27b, all provided on a keypad board as shown, and connected by a flexcable or multiple conductor flexible ribbon 28 to a multiple conductor plug and socket for connection to the electronic components of the electronic lock system.

Figure 3:
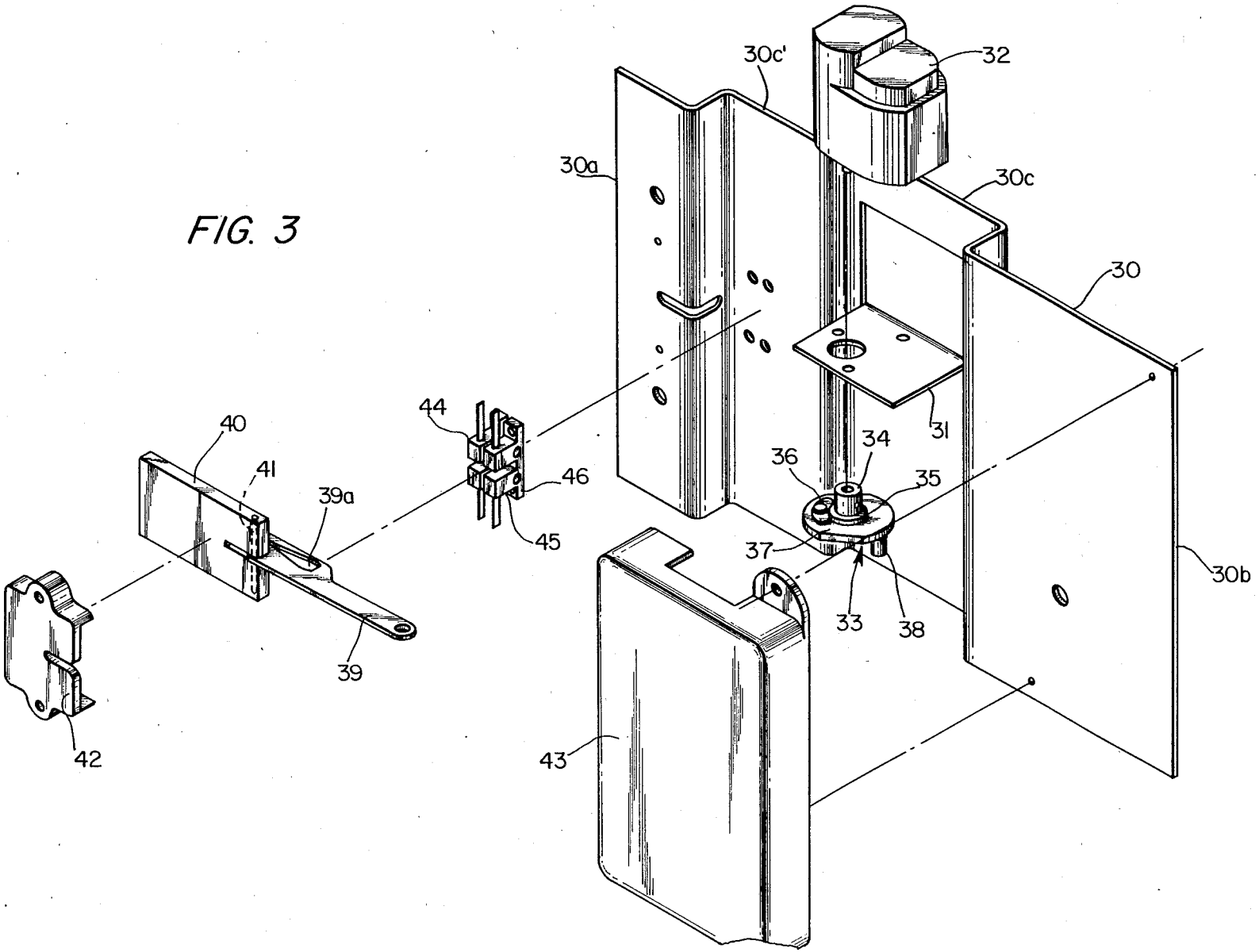
FIG. 3 is an exploded perspective view, viewed from the rear, of the bolt and bolt driving mechanism and associated printed circuit board case and optical sensors, and the mounting base therefor, of the electronic safe lock shown in an inverted position.
Figure 4:
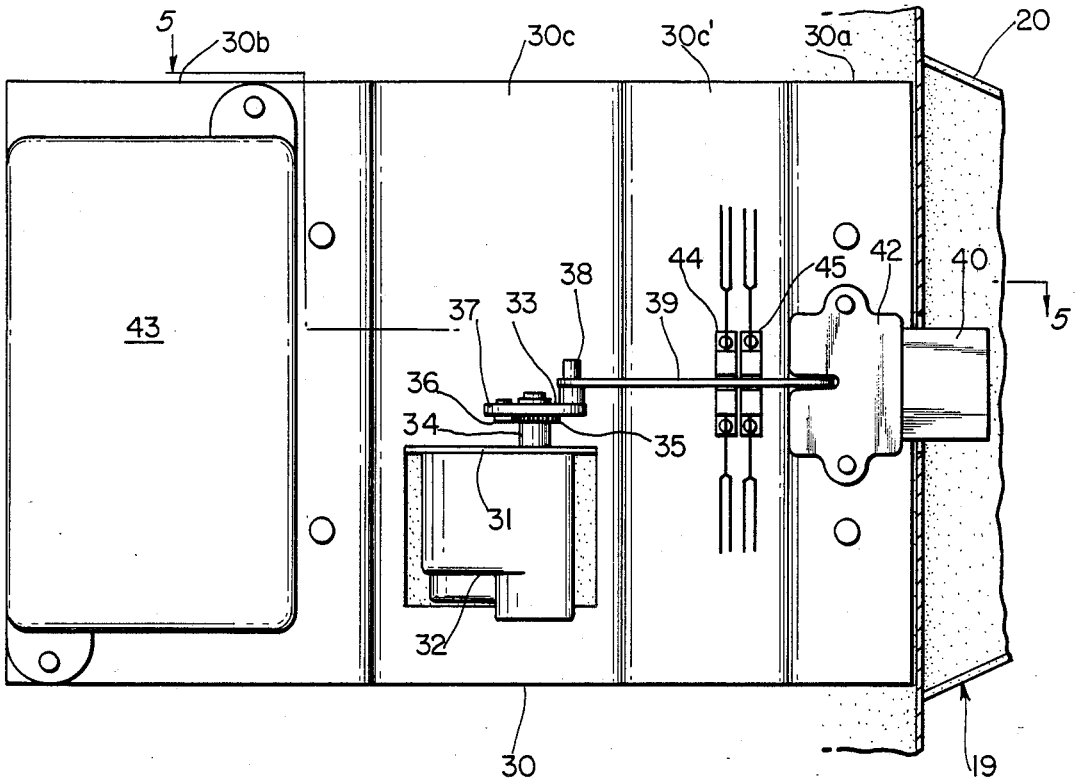
FIG. 4 is a rear elevational view thereof.
Figure 5:
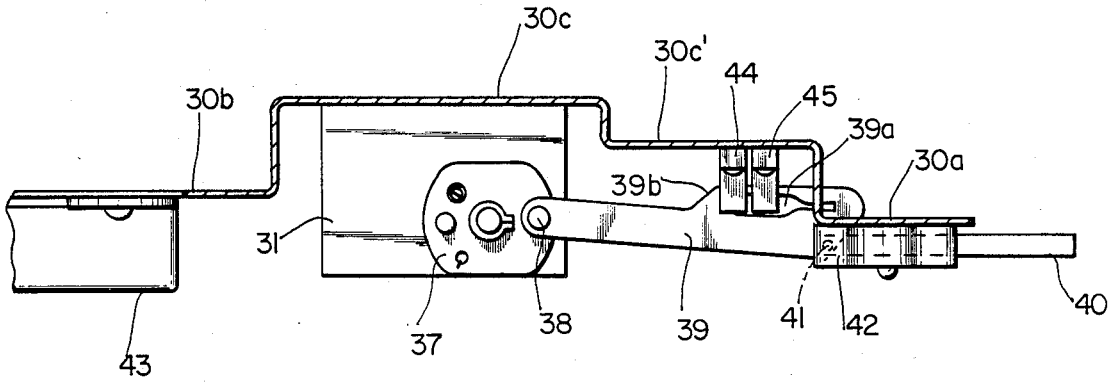
FIG. 5 is a horizontal section view taken along the line 5—5 of FIG. 4.

The structural components of the lock mechanism for the electronic safe lock are best shown in FIGS. 3, 4 and 5, and are preferably provided as a readily mountable assembly fixed to and located between front and rear wall members of the safe door 17. As best illustrated in FIG. 3, the assembly is conveniently supported from a base plate 30 having left and right hand lateral flange panel portions 30a and 30b to be fixed to the front wall or plate member of the door 17 by mounting screws and spacers. Between the two planiform lateral flange panel portions 30a, 30b, is a channel formation including a deeper portion 30 having an integral supporting shelf formation 31 bent outwardly from the base wall of the channel portion 30c and a shallower portion 30c'. The shelf formation 31 supports a DC drive motor 32 by conventional mounting screws extending through the shelf formation and into the casing of the drive motor 32, with the shaft of the motor protruding upwardly through an aperture in the shelf formation 31 and fixed to the primary drive wheel or hub assembly, indicated generally at 33, forming a slip clutch. The primary drive hub assembly 33 comprises a hub 34 fixed, for example by a set screw, to the drive shaft of the motor 32, and includes a toothed flange portion 35 interacting with the tooth on a drive pawl 36 pivotally carried eccentrical on a drive wheel 37. The drive wheel 37 has an eccentric drive pin 38 thereon which projects upwardly through and interfits in and opening therefor in the rearmost end of a rocker arm or link member 39 whose other end extends into a slot in the adjacent end of the bolt 40 and is pinned to the bolt by the coupling pin 41. A bolt guide block 42 of generally U-shaped vertical cross-section defining a channel conforming substantially to the cross-section of the bolt 40 and slidably receiving the bolt therein is fixed by mounting screws to the flange panel portion 30a adjacent the free edge of the door 17. A printed circuit board case or housing 43 is mounted by screws to the other flange panel portion 30b and houses the printed circuit board defining the circuitry for the electronic lock.

Movement of the lock between open and closed positions is monitored by a pair of optical phototransistor sensors 44, 45 oriented to define a pair of vertical sensor beam paths 44x and 45x positioned relative to the elongated opening 39a and the offset excursion 39b in the rocker arm or link member 39 in the illustrated embodiment to sense the rocker arm position. The optical sensors 44, 45 are carried by a sensor supporting bracket 46 mounted by bolts or screws to the shallower portion 30c' of the channel of the base 30 immediately adjacent the bolt guide block 42. In the retracted position of the bolt at its withdrawn or unlocked position (FIG. 8A), the opening 39a in the rocker 39 is aligned with the optical sensor beam path 45x while the other optical sensor beam path 44x is intercepted by the adjoining portion 39c of the rocker arm. When the bolt is located in fully projected or locked position (FIG. 8), the location of the sensors 44, 45 is also such that the sensor beam axis 45x registers with the off-set excursion 39b in the rocker arm and the beam path 44x is uninterrupted.

The lock unit is powered by a battery pack indicated generally at 47, which in the illustrated embodiment is formed of 4 standard alkaline C-size batteries.

The safe lock of the present invention is essentially a microprocessor-controlled programmable electronic safe lock, programmed to provide a master code and one Personal Identification Number code. It is designed primarily for hotel and motel room safes, and is designed to achieve movement of the bolt by motor drive of the bolt 40 through the rocker arm 39 and drive cam or hub assembly 33 formed of the drive hub 37 and drive pawl 36, providing a slip clutch which protects the mechanism from damage in the event the bolt 40 becomes jammed by the door jamb and to protect the mechanism in the event of any interference with the travel of the bolt during its movement from unlocked to locked position. The bolt 40 is assured of straight and true movement by being slidably mounted in the bolt guide block 42 fixed to the lateral flange panel portion 30a of the lock base plate 30. The drive assembly is also positioned slightly over center in the locked and unlocked stage. This is to prevent access into the lock if bolt end pressure is experienced during the locked stage. The entire locking mechanism is mounted on the base plate 30 which is positively attached to the door by way of screw posts, thus facilitating assembly of the mechanism on the base plate and ease of mounting of the assembled mechanism and base plate on the safe door.

Figure 7:
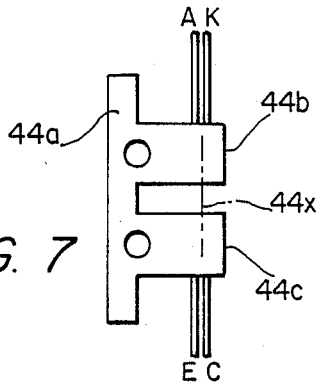
FIG. 7 is an enlarged detail view of one of the optical sensors.
Figure 8:
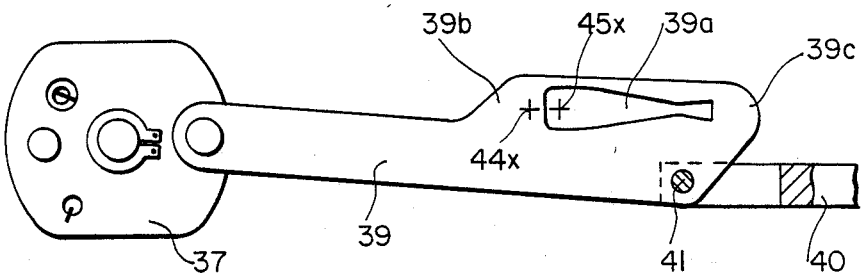
FIGS. 8 and 8A are detail views of the rocker arm and optical axes and associated components in fully locked and unlocked positions, respectively.
Figure 8A:
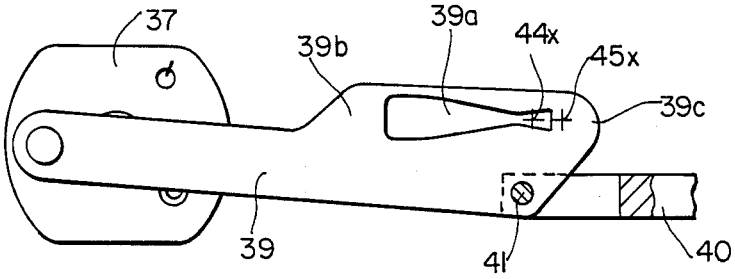

The two optical sensors 44, 45 are in the form of two diode and phototransistor sets, illustrated in greater detail in FIG. 7, each of which includes a mounting block 44a having a base portion and two protruding lobes or block formations 44b, 44c extending therefrom. These block formations 44b and 44c support an anode element A, a cathode element K, and an emitter E, and a collector C, in the illustrated embodiment, collectively forming the input diode and an output phototransistor, which may be a TRW slotted optical switch type OPB806, as one appropriate example. These elements define a pair of beam or sensor optical paths 44x or 45x located side by side at an appropriate position for sensing positions of the rocker arm 39. This is illustrated in greater detail in FIG. 8A, showing the rocker arm 39 and the beam or optical sensor axes 44x and 45x located relative to the rocker arm 39 for the fully retracted position of the bolt 40. FIG. 8 illustrates the same components, but showing the location of the optical beam paths 44x, 45x relative to the rocker arm 39 when the bolt is in the fully projected or locked position.

In the illustrated embodiment, the key pad 27 is of Mylar construction with positive touch pressure switches, and is color coded to easily identify the different functions.

The microprocessor logic and controls preferably provide the following features:

(1) The program is user friendly with a LCD readout that takes the user through the simple steps.

(2) The program provides a confirm statement to give the user added time to make sure the code put in is indeed the intended code.

(3) When not being used, the PCB will remain dormant to conserve power. To "wake" the unit up, the operator must press the "ON" button. The display will remain on until the operator has completed its input or will go back to being dormant after one minute.

(4) The five-digit user code provides individual security. A random five digit must be entered each time the unit is locked.

(5) The six digit Master Code allows a hotel official to access the safe when user codes are forgotten, to override the penalty time, and to change the Master Code.

The lock has an audible beeper that will give different tones indicating the keypad is being activated, a wrong code has been entered, or the penalty time has been activated.

(6) A wrong code entered four times will result in a twenty-minute penalty time. The LCD will read "PENALTY TIME", "CALL DESK" for a period of twenty seconds and then will go dormant. If any button is pushed during the penalty time, the LCD will display the message again for twenty seconds.

(7) In the event the bolt gets jammed against the door jamb, the LCD will read "BOLT JAMMED", "PUSH DOOR". If no response is made by the operator, the unit will go into the dormant stage.

(8) If the unit is turned on and the bolt is not in the proper location, the LCD will read "SENSOR ALIGNMENT" and the operator must go through the locking sequence two times. The first sequence will put the bolt in the corrected position and the second sequence will allow the safe to be locked.

(9) The locking sequence contains enough steps to eliminate a child from inadvertently locking the safe.

(10) After the unit is turned on, the LCD will display "LOW POWER", "CALL DESK", when the voltage drops below five volts.

In practice, it is contemplated that each room of a hotel will have such an electronic lock controlled safe for the guest to use. Every time the safe is used, the guest will be required to put in his own 5 digit code, selected at will by the guest. When the guest first uses the safe, it will be in the unlocked and dormant state. After going through a sequence of steps, as directed by the microprocessor and shown on the LCD display, the guest will enter his own arbitrary 5 digit code and lock the safe. To unlock the safe, the same five digits will need to be entered. Once opened, the guest must once again enter an arbitrary 5 digit code to lock the safe.

As an example of the safe locking procedure, the following operational program may be provided:

| TO LOCK THE SAFE: | |
|---|---|
| KEYPAD | LCD READOUT |
| Press "ON" | "Enter 5 digits" |
| Press any five digits | "Is code correct" |
| | "- - - - -" |
| | "Yes or No" |
| Press "Yes" | "Press Lock" |
| Press "LOCK" | "Locked" |
| TO OPEN THE SAFE: | |
| Press "On" | "Enter code" |
| Press the correct 5 digits | "Press open |
| Press "Open" | "Open" |

-continued

If for any reason, the customer forgets his code, the system is equipped with a Master Code (6 digits) that would be held by the Hotel Manager. The same sequence (as listed above under "To Open The Safe") is used. However, when the LCD reads "Enter Code", the Manager would enter the six-digit Master Code. The safe is initially set with a Master Code of "111111". The bolt action also goes through 1½ cycles in the event that the location of the bolt has been tampered with.

To change the Master Code, the safe must be opened. The code can then be changed by the following sequence:

| Keypad | LCD Readout |
|---|---|
| Press "ON" | "Enter 5 digits" |
| Enter Master Code 111111, followed by 99 | "11111199" |
| | "Enter new master" |
| Enter new 6 digit Master COde | "- - - - - -" |
| Push "Confirm" | "Buzzer will sound 2 beeps, buzz, 2 beeps to indicate the code is being saved. |
| | "Open" |
| | Powers down. |

In the event of an obstruction of the bolt during operation (such as the door not being fully closed when locking, or the door being pulled on while unlocking), the LCD will read "Bolt Jammed", "Push Door" and an alarm will beep. If no action taken, the system will shut down.

If, at any time, the bolt is not in the proper location when the unit is turned on, the LCD will read "Sensor Alignment" and the system will return it to the proper location.

When the safe is locked and someone is trying to unlock it, they will only get four tries. After the fifth try, the LCD will read "Penalty Time" "Call Desk". The messages will continue to flash for a period of 20 seconds and then the system will go into the dormant state. Pressing any button will cause the LCD to flash for another 20 seconds. The penalty time will continue for a total of 20 minutes. The Master Code does, however override the penalty time provided the Master Code is entered while "Penalty Time" "Call Desk" is flashing.

I claim:

1. An electronic lock controlled safe for hotel rooms and the like comprising a box-like safe defining a security enclosure having side, rear, top and bottom walls and a safe door and door frame for a front wall therefor, an electronic lock mounted on said door including a forwardly exposed keyboard and display means including a keypad having plural finger-actuated keys with associated numerals and legends and a display window and associated electrically activated alpha-numeric display strip located adjacent the keypad for displaying messages through the display window to an operator; a lock mechanism on the door including a bolt movable between projected and retracted positions respectively for locking and unlocking the door, an electric motor and drive wheel means driven thereby including a slip clutch mechanism, a movable link member coupled to the slip clutch mechanism and the bolt, photoelectric light sensor means positioned adjacent the link member providing sensor beam paths selectively intercepted by portions, the link member for sensing predetermined positions of the link member for producing sensor signals, and electronic circuit means responsive to signals from the keypad keys and said sensor signals for activating said display strip to display predetermined messages and for activating said electric motor to move said bolt to said projected and retracted positions.

2. An electronic locked controlled safe as defined in claim 1, wherein said electronic circuit means includes micro-processor means having means for energizing the electric motor responsive to signals produced by finger-actuation of said keys in accordance with the selected plural digit numerical code to retract the bolt from unlocking position.

3. An electronic locked controlled safe as defined in claim 1, wherein said electronic circuit means include micro-processor means having memory means responsive to finger activation of said keys in accordance with a plural digit input numeric code to store said input numeric code and means for energizing the electric motor responsive to signals produced by actuation of the keys only when the keys are actuated in accordance with said input numeric code to thereby retract the bolt to unlocking position.

4. An electronic locked controlled safe as defined in claim 1, wherein said electronic circuit means include micro-processor means having memory means responsive to finger activation of said keys in accordance with a plural digit input numeric code to store said input numeric code and means for energizing the electric motor responsive to signals produced by actuation of the keys only when the keys are actuated in accordance with said input numeric code to thereby retract the bolt to unlocking position and including circuitry removing a stored input code from the memory means upon one actuation of the keys in accordance with such stored input code and associated circuitry bolt retraction and rendering the memory means responsive to store a new input code.

5. An electronic lock controlled safe for hotel rooms as defined in claim 1, wherein said photoelectric light sensor means comprise two side-by-side paired sets of photoelectric transmitting and receiving components defining first and second sensor paths to be intercepted by said link member, and said link member beam having a shaped opening and adjacent boundary portions therein positioned relative to said first and second sensor beam paths whereby the first beam path is interrupted by said boundary portions of the link member and the second sensor beam path passes through said opening when the bolt occupies its projected position and said second sensor beam is interrupted by said boundary portions and the first sensor beam passes through said opening at the retracted position of the bolt.

6. An electronic lock control safe for hotel rooms as defined in claim 2, wherein said photoelectric light sensor means comprise two side-by-side paired sets of photoelectric transmitting and receiving components defining first and second sensor paths to be intercepted by said link member, and said link member having a shaped opening and adjacent boundary portions therein positioned relative to said first and second said boundary portions of the link member and the second sensor beam path passes through said opening when the bolt occupies its projected position and said second sensor beam is interrupted by said boundary portions and the first sensor beam passes through said opening at the retracted position of the bolt.

7. An electronic lock controlled safe for hotel rooms as defined in claim 3, wherein said photoelectric light sensor means comprise two side-by-side paired sets of photoelectric transmitting and receiving components defining first and second sensors paths to be intercepted by said link member, and said link member having a shaped opening and adjacent boundary portions therein positioned relative to said first and second sensor beam paths whereby the first beam path is interrupted by said boundary portions of the link member and the second sensor beam path passes through said opening when the bolt occupies its projected position and said second sensor beam is interrupted by said boundary portions and the first sensor beam passes through said opening at the retracted position of the bolt.

8. An electronic lock controlled safe for hotel rooms as defined in claim 4, wherein said photoelectric light sensor means comprise two side-by-side paired sets of photoelectric transmitting and receiving components defining first and second sensors paths to be intercepted by said link member, and said link member having a shaped opening and adjacent boundary portions therein positioned relative to said first and second sensor beam paths whereby the first beam path is interrupted by said boundary portions of the link member and the second sensor beam path passes through said opening when the bolt occupies its projected position and said second sensor beam is interrupted by said boundary portions and the first sensor beam passes through said opening at the retracted position of the bolt.

9. An electronic lock control safe for hotel rooms as defined in claim 1, wherein said slip clutch mechanism comprises a hub member and a drive wheel and a pawl and plural tooth coupling means intercoupling the drive wheel and hub portion and an eccentric pin connected to said link member to provide a slip clutch drive between the electric motor and the link member preventing damage to the mechanism if the bolt becomes jammed during movement between retracted and projected positions.

10. An electronic lock controlled safe for hotel rooms as defined in claim 2, wherein said slip clutch mechanism comprises a hub member and a drive wheel and a pawl and plural tooth coupling means intercoupling the drive wheel and hub portion and an eccentric pin connected to said link member to provide a slip clutch drive between the electric motor and the link member preventing damage to the mechanism if the bolt becomes jammed during movement between retracted and projected positions.

11. An electronic lock controlled safe for hotel rooms as defined in claim 3, wherein said slip clutch mechanism comprises a hub member having teeth about the perimeter thereof and a drive wheel having a pawl releasably coupled with said teeth and an eccentric pin connected to said link member to provide a slip clutch drive between the electric motor and the link member preventing damage to the mechanism if the bolt becomes jammed during movement between retracted and projected positions.

12. An electronic lock controlled safe for hotel rooms as defined in claim 4, wherein said slip clutch mechanism comprises a hub member having teeth about the perimeter thereof and a drive wheel having a pawl releasably coupled with said teeth and an eccentric pin connected to said link member to provide a slip clutch drive between the electric motor and the link preventing damage to the mechanism if the bolt becomes jammed during movement between retracted and projected positions.

13. An electronic lock controlled safe for hotel rooms as defined in claim 5, wherein said slip clutch mechanism comprises a hub member having teeth about the perimeter thereof and a drive wheel having a pawl releasably coupled with said teeth and an eccentric pin connected to said link member to provide a slip clutch drive between the electric motor and the link preventing damage to the mechanism if the bolt becomes jammed during movement between retracted and projected positions.

14. An electronic lock controlled safe for hotel rooms as defined in claim 6, wherein said slip clutch mechanism comprises a hub member having teeth about the perimeter thereof and a drive wheel having a pawl releasably coupled with said teeth and an eccentric pin connected to said link member to provide a slip clutch drive between the electric motor and the link preventing damage to the mechanism if the bolt becomes jammed during movement between retracted and projected positions.

15. An electronic lock controlled safe for hotel rooms as defined in claim 7, wherein said slip clutch mechanism comprises a hub member having teeth about the perimeter thereof and a drive wheel having a pawl releasably coupled with said teeth and an eccentric pin connected to said link member to provide a slip clutch drive between the electric motor and the link preventing damage to the mechanism if the bolt becomes jammed during movement between retracted and projected positions.

16. An electronic lock controlled safe for hotel rooms as defined in claim 8, wherein said slip clutch mechanism comprises a hub member having teeth about the perimeter thereof and a drive wheel having a pawl releasably coupled with said teeth and an eccentric pin connected to said link member to provide a slip clutch drive between the electric motor and the link preventing damage to the mechanism if the bolt becomes jammed during movement between retracted and projected positions.

17. An electronic lock controlled safe as defined in claim 3, wherein said micro-processor means includes circuitry rendering said circuit means responsive to a selected multi-digit master code to enable override unlocking of the lock regardless of any said input numeric code stored therein.

18. An electronic lock controlled safe as defined in claim 4, wherein said micro-processor means includes circuitry rendering said circuit means responsive to a selected multi-digit master code to enable override unlocking of the lock regardless of any said input numeric code stored therein.

* * * * *